US006823542B2

(12) United States Patent
Berge

(10) Patent No.: US 6,823,542 B2
(45) Date of Patent: Nov. 30, 2004

(54) MAT CONVEYOR HAVING MULTIPLE HANDLES

(76) Inventor: Trygve Berge, 0022 Cove Blvd., Dillon, CO (US) 80435

( * ) Notice: Subject to any disclaimer, the term of this patent is extended or adjusted under 35 U.S.C. 154(b) by 0 days.

(21) Appl. No.: 10/374,463

(22) Filed: Feb. 25, 2003

(65) Prior Publication Data

US 2004/0163176 A1 Aug. 26, 2004

(51) Int. Cl.[7] ..... A61G 7/14

(52) U.S. Cl. ..... 5/81.1 HS; 5/81 C; 5/627; 5/625; 16/444

(58) Field of Search ..... 5/81.1 R, 81.1 HS, 5/81.1 C, 81.1 T, 627, 625; 16/444

(56) References Cited

U.S. PATENT DOCUMENTS

| | | | | |
|---|---|---|---|---|
| 1,795,435 A | | 3/1931 | Melzer | |
| 3,284,816 A | | 11/1966 | Laubsch | 5/81 |
| 3,829,914 A | * | 8/1974 | Treat | 5/81.1 R |
| 3,849,813 A | | 11/1974 | Neilson | 5/334 |
| 4,051,565 A | | 10/1977 | Berge | 5/81 |
| D346,346 S | | 4/1994 | Johnson et al. | D12/128 |
| 5,327,597 A | | 7/1994 | Rothbard | 5/481 |
| 5,638,586 A | | 6/1997 | Malin et al. | 24/587 |
| 5,638,588 A | | 6/1997 | Jungkind | 24/68 |
| 6,012,183 A | * | 1/2000 | Brooke et al. | 5/81.1 C |
| D445,286 S | | 7/2001 | Rhyne | D6/610 |
| 6,374,435 B1 | * | 4/2002 | Lrininger et al. | 5/81.1 C |
| 2002/0029417 A1 | * | 3/2002 | Walker | 5/81.1 T |

FOREIGN PATENT DOCUMENTS

| | | | | |
|---|---|---|---|---|
| GB | 2159047 A | * | 11/1985 | 5/81.1 HS |

OTHER PUBLICATIONS

Selected pages from website http://www.clidemat.com/Pages/applications.html, 2 pages total.
Transcription of video found on website; http://www.clidemat.com/Pages/vidwin.html 1 page total.
Declaration of Inventor Trygve Berge 2 pages total.

* cited by examiner

*Primary Examiner*—Alexander Grosz
(74) *Attorney, Agent, or Firm*—Sheridan Ross P.C.

(57) ABSTRACT

A mat conveyor includes a tubular fabric member formed of a soft flexible material and having an interior passage formed therein. A plurality of handle bands are secured to the exterior surface of the tubular member. Each of the handle bands utilizes a support band secured to the exterior surface of the tubular member together with an overlying outer band secured to the support band at a plurality of spaced attachments. The portions of the outer band extending between attachments form a plurality of handle members generally spaced about the tubular member. A pair of carrying poles are receivable within the tubular member interior passage to convert the tubular member to a stretcher-like carrier.

6 Claims, 1 Drawing Sheet

MAT CONVEYOR HAVING MULTIPLE HANDLES

FIELD OF THE INVENTION

This invention relates generally to portable conveyors or transportation units for injured or impaired persons and particularly to those formed of a soft fabric material.

BACKGROUND OF THE INVENTION

One of the most difficult aspects of patient care and treating of persons at the scene of injury or the like imposed upon medical practitioners is the movement or handling of the patients themselves. Practitioners are required in many circumstances to transfer impaired or injured persons between one resting place or another or, in some instances, transport an injured person from an accident environment to a portable bed or stretcher or the like.

The difficulties of moving people and transferring them from one support surface to the other is often exacerbated by the size and weight of the individual as well as restricted or cramped working area. in addition, there often exists a very real possibility of causing further injury or aggravating existing injuries in the movement process.

All this combines to make the movement and transfer of injured or impaired persons difficult, strenuous and exacting for medical practitioners and emergency response personnel.

Practitioners in the art have attempted to respond to this is need by providing some type of transport system for laterally shifting an individual. Such devices have included mechanized beds and stretchers which are often power driven and which may be adjusted to a variety of heights. often such devices are integrally related to support apparatus such as transportation vehicles and ambulances or the like. Such apparatus, however, are relatively cumbersome and complex and are often unsuited for certain lifting and transferring operations which need nonetheless to be performed.

U.S. Pat. No. 4,051,565 issued to Berge sets forth a MAT CONVEYOR which provides a lightweight, portable conveyor or transportation unit for moving heavy or fragile objects and which is particularly suited for the movement of injured humans as between supporting carriers, such as hospital emergency carts or tables, and a patient bed, or vice versa. The transportation unit comprises an open-ended, flexible tube-like member, the flexible walls of which collapse inwardly to form a double layer mat having a wear-resistant exterior layer or surface composed of tough flexible material and which may include an under cushion for the support of the patient's body. An inner layer or lining of flexible material having a low coefficient of friction is laminated coextensively over the inner face of the exterior layer. Objects are placed on the upper face of the mat and is transported over an undersupporting surface by moving the collapsed flexible walls of the tube transversely of the tubular axis with the interengaged opposing surfaces of the slippery interior lining providing a desired low friction interface between the object and undersupporting surface.

While the foregoing described prior art devices have served certain needs and have improved the capability of medical practitioners and emergency response personnel in lifting or transferring patients under various conditions, there remains nonetheless a continuing need in the art for evermore improved flexible and inexpensive conveyor or transportation devices to meet the variety of circumstances in which such devices must be employed.

SUMMARY OF THE INVENTION

Accordingly, it is a general object of the present invention to provide an improved mat conveyor having greater flexibility of use. It is a more particular object of the present invention to provide an improved mat conveyor having a plurality of handle devices to aid in the lifting and transport of injured or impaired persons.

In accordance with the present invention, there is provided for use in lifting and moving a person, a conveyor comprises: an elongated tubular member formed of a flexible material and defining an interior surface and an exterior surface; and a plurality of flexible handle members disposed upon the exterior surface each defining a closed handle loop secured to the exterior surface at two attachment points, the handle members being distributed about the exterior surface such that at least two of the handle members remain accessible as the tubular member is rolled laterally in a generally flattened configuration.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DETAILED DESCRIPTION

Figure 1:
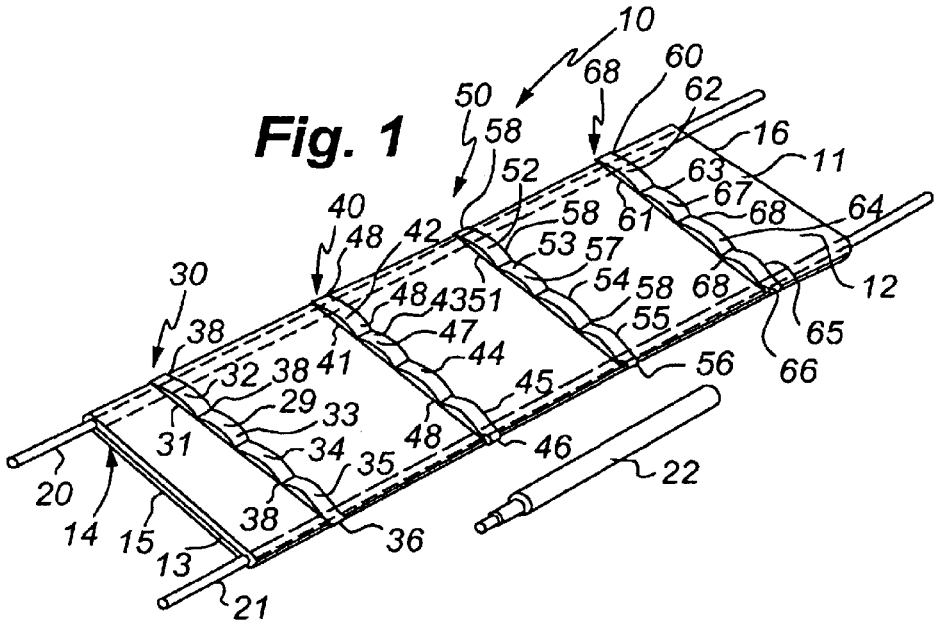
FIG. 1 sets forth a perspective view of a mat conveyor constructed in accordance with the present invention.

FIG. 1 sets forth a perspective view of a mat conveyor having multiple handles and generally referenced by numeral 10. Mat conveyor 10 includes an elongated generally cylindrical flexible tubular member 11 defining an exterior surface 12 and an interior surface 13. Tubular member 11 is preferably formed as a generally cylindrical fabric member having an interior passage 14 (seen in FIG. 2) extending therethrough between end portions 15 and 16. In its preferred form, tubular member 11 is fabricated of a soft flexible material such as padded fabric or the like and thus, when resting upon a flat surface, tends to assume the flattened configuration shown in FIGS. 1 and 2. While different fabrications for tubular member 11 may be utilized which will benefit from practicing the present invention, it has been found advantageous to utilize a structure for tubular member 11 similar to that set forth in the above-referenced U.S. Pat. No. 4,051,565.

In accordance with the present invention, a plurality of encircling handle bands 30, 40, 50 and 60 are spaced upon exterior surface 12 and secured thereto in the manner described below. Handle bands 30 and 60 are positioned proximate or spaced from end portions 15 and 16 respectively while handle bands 40 and 50 are positioned in a spaced apart relationship between handle bands 30 and 60. In the manner set forth below in greater detail, handle band 30 includes a ribbon-like fabric support band 31 preferably formed of a high strength fabric material which is of sufficient length to encircle tubular member 11. As is better seen in FIG. 4, fabric support band 31 is secured to exterior surface 12 of tubular member 11 by a high strength attachment such as a plurality of stitched seams 37 and 39. Additional strength may be obtained by further attachment means applied to fabric support band 31. Handle band 40 further includes an outer band 29 which encircles tubular member 11 in a similar manner to fabric support band 31 and which generally overlies fabric band 31. A plurality of transversed stitched seams 38 attach outer band 29 to handle band 30 at a plurality of attachment points which are generally evenly spaced about fabric support band 31. The stitching attachment of seams 38 may, in accordance with fabrication preferences, either be limited to attachment of fabric support band 31 and outer band 29 or may further include attachment to the underlying portion of tubular member 11. In either event, the use of stitched seams 38 to provide spaced apart attachment of outer band 29 to fabric support band 31 forms a plurality of handle members 32 through 36 and 25 through 28 (handles 25 through 28 are better seen in FIG. 2).

Handle bands 40, 50 and 60 are formed in the identical manner to that described for handle band 30 and thus the descriptions set forth herein for handle band 30 should be understood to apply equally well to handle bands 40, 50 and 60. Thus, handle bands 40, 50 and 60 are fabricated of corresponding fabric support bands 41, 51 and 61 to which outer bands 47, 57 and 67 respectively are secured by a plurality of spaced apart transverse stitched seams 48, 58 and 68 respectively. It should be understood that fabric support bands 41, 51 and 61 are similarly attached to tubular member 11 in the manner described for fabric support band 31.

To further aid the lifting process of mat conveyor 10, a pair of elongated pole members 20 and 21 are provided and in their anticipated use are extended through interior passage 14 of tubular member 11 and extend beyond end portions 15 and 16. For further convenience and ease of transportability, poles 20 and 21 may be fabricated in a telescoping or collapsing structure such as pole 22 which utilizes a plurality of concentrically shaped telescoping members to collapse for convenient transport and storage.

Figure 2:
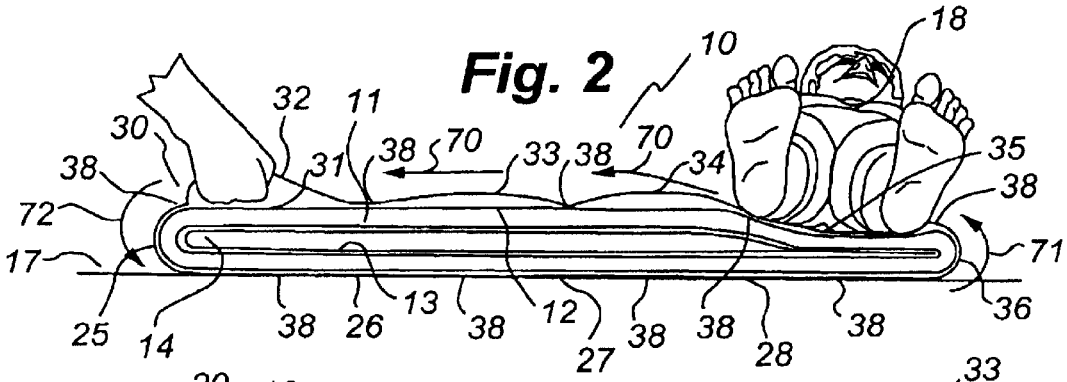
FIG. 2 sets forth an end view of the present invention mat conveyor supporting a patient.

FIG. 2 sets forth a bottom end view of the present invention mat conveyor resting upon a support surface 17 and receiving a patient 18. As described above, mat conveyor 10 includes a tubular member 11 having an interior surface 13 and an exterior surface 12. A passage 14 extends through tubular member 11 and a plurality of handle bands 30, 40, 50 and 60 are secured to the outer surface of tubular member 11.

With tubular member 11 resting upon surface 17 and with poles 20 and 21 removed therefrom, tubular member 11 assumes a generally relaxed flattened shape as shown. In accordance with the present invention, a patient 18 is initially positioned upon conveyor mat 10 and rests thereupon. In further accordance with the present invention, the user may grasp one or more of the handle members of handle bands 30, 40, 50 and 60 (seen in FIG. 1) at any convenient point in order to draw the upwardly facing portion of tubular member 11 in the directions indicated by arrows 70. The flexible structure of tubular member 11 and the friction created between exterior surface 12 and surface 17 cause tubular member 11 to roll upon itself carrying patient 18 along the upper portion of tubular member 11 in the direction indicated by arrows 70. In accordance with an important of the present invention, the plurality of handle members formed in handle bands 30, 40, 50 and 60 greatly facilitate this process. In addition, the provision of such handle members about the entire outer surface of tubular member 11 assures that handle members will be conveniently accessible to the user despite the rolling operation used to move patient 18. Thus, as the user grasps handle member 32, for example, and draws handle member 32 toward the user in the direction of arrow 70, tubular member 11 rolls upon itself moving patient 18. Concurrently, the rolling motion of tubular member 11 carries handle member 32 to the undersurface in the direction of arrow 72 while advancing handle members 33, 34 and 35 and bringing handle member 36 upwardly from the under portion of tubular member 11 to the top portion thereof. Thus, the user is able to further roll tubular member 11 by simply releasing handle member 32 and grasping the next succeeding convenient handle such as handle member 33 or 34.

It should be understood by simultaneous reference to FIGS. 1 and 2 that the user would normally exercise the present invention handle members by reaching simultaneously for a pair of handle members. Similarly, a second person assisting the user would be able to grasp one or more of the handle members upon handle bands 40, 50 or 60 and thereby aid the user.

In accordance with a further advantage of the present invention, the use of flexible handle bands 30, 40, 50 and 60 accommodates the flexibility of tubular member 11 and cooperates with tubular member 11 in rolling upon itself to provide the above-described advantageous patient moving mechanism. It will be apparent to those skilled in the art that once patient 18 is generally centered upon the upwardly facing portion of tubular member 11, the user may grasp convenient handle members and lift or move patient 18. Thus, it is anticipated that two or more users may be able to lift patient 18 using handle members at the outer portions of tubular member 11.

Figure 3:
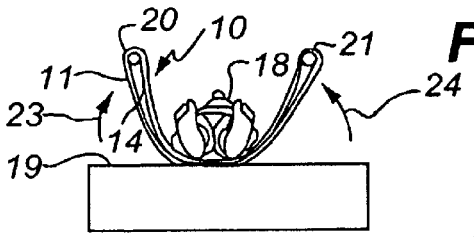
FIG. 3 sets forth a bottom view of the present invention mat conveyor configured to lift a typical patient.

FIG. 3 sets forth the configuration of mat conveyor 10 in which patient 18 is generally centered upon mat conveyor 10 and poles 20 and 21 are inserted through interior passage 14. When so configured, practitioners may then grasp the end portions of poles 20 and 21 and raise them upwardly in the directions indicated by arrows 23 and 24 respectively to provide a stretcher-like carrying action for mat conveyor 10. Thus, the user is able to carry patient 18 using either poles 20 and 21 or grasping the conveniently available handle members provided by handle bands 30, 40, 50 or 60. In further addition, in the event that patient 18 is being moved from a restrictive cramped area which does not facilitate the insertion of poles 20 and 21 through interior passage 14, collapsible poles such as pole 22 may be utilized having the advantage of being insertable into passage 14 by being initially placed therein in a collapsed condition and thereafter expanded within interior passage 14 thus operating in restricted space environments.

Figure 4:
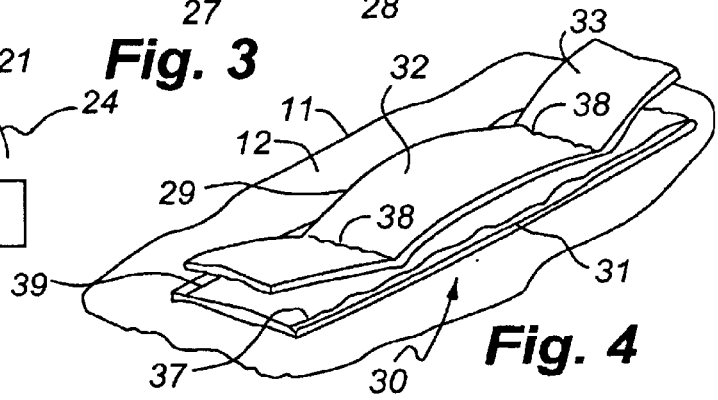
FIG. 4 sets forth a partial section view of the handle portion of the present invention mat conveyor.

FIG. 4 sets forth a sectioned perspective view of handle band 30. As described above, handle band 30 includes a flexible high strength ribbon forming a fabric support 31. Fabric support band 31 is secured to exterior surface 12 by a high strength attachment such as a pair of stitched seams 37 and 39. An outer band 29 also formed of a ribbon-like high strength fabric member overlies fabric support band 31 and is stitched thereto in a plurality of transverse stitched seams 38 which are sufficiently spaced to form a plurality of handle members therebetween such as handle member 32. It should be noted that the degree of space between the handle members formed by outer band 29 and fabric support band 31 is a matter of design choice. The degree of space shown in FIGS. 1 through 4 is, for the most part, exaggerated from the anticipated spacing. However, it will be apparent to those skilled in the art that virtually any spacing 11 may be utilized without departing from the spirit and scope of the present invention.

An important aspect of the present invention is the use of flexible handle bands such as bands 30, 40, 50 and 60 which provide a plurality of handle members encircling the exterior surface of tubular member 11 and thus providing convenient gripping or grasping handles regardless of the configuration of tubular member 11. In addition, the flexibility of handle bands 30, 40, 50 and 60 assures that mat conveyor 10 may be utilized in the rolling operation set forth and described which easily moves a patient across the mat conveyor to and from its upwardly facing surface.

What has been shown is an improved mat conveyor which utilizes a plurality of flexible handle bands to form a plurality of handle members which facilitate the carrying operation of the present invention mat while cooperating with the rolling action thereof. Pole members may be utilized to further enhance the carrying capability of the present invention mat conveyor and may be either elongated one piece poles or fabricated of a collapsible design to facilitate operations in cramped operative environments.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. For use in lifting and moving a person, a conveyor comprising:

an elongated tubular member formed of a flexible material and defining an interior surface and an exterior surface;

a plurality of flexible handle members disposed upon said exterior surface each defining a closed handle loop secured to said exterior surface at two attachment points;

said handle members being distributed about said exterior surface such that at least two of said handle members remain accessible as said tubular member is rolled laterally in a generally flattened configuration;

said handle members being arranged to form at least a pair of bands proximate said opposed ends and generally evenly spaced therefrom;

a first planar band of high-strength flexible fabric secured to said exterior surface of said tubular member in an encircling manner;

a second planar band of high strength flexible fabric generally overlying said first planar band; and means for attaching said second planar band to said first planar band at spaced apart attachment points such that portions of said second planar band between said attachment points form said closed loop handles.

2. A conveyor as set forth in claim 1 wherein said means for attaching includes sewn stitches.

3. A conveyor as set forth in claim 2 wherein said flexible handle members include four encircling bands on said exterior surface.

4. A conveyor as set forth in claim 2 further including a pair of elongated rigid pole members extendable through said tubular member and greater in length than said tubular member.

5. A conveyor as set forth in claim 4 wherein said elongated rigid pole members are collapsible to reduced lengths.

6. A method of moving a person while lying on a conveyor apparatus, said method comprising the steps of:

providing an elongated tubular member formed of a flexible material and defining an interior surface and an exterior surface;

providing a plurality of flexible handle members disposed upon said exterior surface each defining a closed handle loop secured to said exterior surface at two attachment points, said handle members being distributed about said exterior surface such that at least two of said handle members remain accessible as said tubular member is rolled laterally in a generally flattened configuration, said handle members being arranged to form at least a pair of bands proximate said opposed ends and generally evenly spaced therefrom, the bands extending transversely with respect to a length of the tubular member, and the person lying transversely with respect to the bands, said handle members including a first planar band of high-strength flexible fabric secured to said exterior surface of said tubular member in an encircling manner, and a second planar band of high strength flexible fabric generally overlying said first planar band;

providing means for attaching said second planar band to said first planar band at spaced apart attachment points such that portions of said second planar band between said attachment points form said closed loop handles;

grasping a pair of the flexible handle members; and pulling the handle members in a direction transverse to the patient and parallel to the direction of extension of the bands wherein the elongated tubular member rotates in response thereto thereby moving a person a desired distance.

* * * * *